US005960983A

United States Patent [19]

Chan

[11] Patent Number: 5,960,983

[45] Date of Patent: Oct. 5, 1999

[54] COLLAPSIBLE GARBAGE RECEPTACLE

[76] Inventor: Chin Chung Chan, 4F, No. 131-18, Sec 2, Kee-Lung Road, Taipei, Taiwan

[21] Appl. No.: 08/944,414

[22] Filed: Oct. 6, 1997

[51] Int. Cl.[6] ..... B65D 23/00

[52] U.S. Cl. ..... 220/666; 220/489; 220/908

[58] Field of Search ..... 220/666, 489, 220/490, 907, 908, 667, 668

[56] References Cited

U.S. PATENT DOCUMENTS

| | | | |
|---|---|---|---|
| Re. 24,581 | 12/1958 | Escaut | 220/489 |
| 216,227 | 6/1879 | Sedgwick | 220/666 |
| 872,792 | 12/1907 | Boyle | 220/490 |
| 2,942,750 | 6/1960 | Negly | 220/489 |
| 3,107,712 | 10/1963 | Bergeretto | 220/666 |
| 4,157,103 | 6/1979 | La Fleur | 220/666 |
| 5,267,664 | 12/1993 | Younikian | 220/489 |
| 5,310,068 | 5/1994 | Saghri | 220/666 |
| 5,706,872 | 1/1998 | Schlesinger | 220/666 |

*Primary Examiner*—Joseph M. Moy
*Attorney, Agent, or Firm*—Rosenberg, Klein & Bilker

[57] ABSTRACT

A collapsible garbage receptacle which includes a base having an upright outer wall raised around the periphery and a plurality of equiangularly spaced upright retaining flanges surrounded by the upright outer wall; an annular top cover frame having a plurality of equiangularly spaced retaining flanges raised from a bottom side thereof; and a collapsible springy receptacle body connected between the base and the annular top cover frame, the collapsible springy receptacle body having a top metal ring fastened to the retaining flanges of the annular top cover frame, a bottom metal ring fastened to the retaining flanges of the base, and a plurality of springy ribs connected between the top metal ring and the bottom metal ring in such a manner that the collapsible springy receptacle body is collapsed when the top metal ring and the bottom metal ring are twisted and attached to each other.

9 Claims, 7 Drawing Sheets

COLLAPSIBLE GARBAGE RECEPTACLE

BACKGROUND OF THE INVENTION

The present invention relates to garbage receptacles, and more particularly to a collapsible garbage receptacle which is comprised of a top cover frame, a base tray, and a springy receptacle body connected with the top cover frame and the base tray collasiblly by a relative twisting there between.

Conventional garbage receptacles (garbage-cans) commonly have a fixed receptacle body for holding household rubbish. Because conventional garbage receptacles are not collapsible, much warehouse space is required for storing garbage-cans before they are delivered out of the factory. Further, the transportation cost for these kinds of garbage receptacles is also high. There is known a build-up garbage receptacle that can be set up by the consumer. However, the parts of the garbage receptacle well collected when they are detached from each other. If one part of the garbage receptacle is lost, the user can no longer set up the garbage receptacle again.

SUMMARY OF THE INVENTION

The present invention has been accomplished to provide a garbage receptacle which eliminates the aforesaid drawbacks. It is one object of the present invention to provide a collapsible garbage receptacle that can be conveniently collapsed by twisting. It is another object of the present invention to provide a collapsible garbage receptacle that can be conveniently returned to its operative condition after it is collapsed. According to one aspect of the present invention, the collapsible garbage receptacle comprises a base tray having an upright outer wall raised around the periphery and a plurality of equiangularly spaced upright retaining flanges surrounded by the upright outer wall; an annular top cover frame having a plurality of equiangularly spaced retaining flanges raised from a bottom side thereof; and a collapsible springy receptacle body connected between the base tray and the annular top cover frame, the collapsible springy receptacle body having a top metal ring fastened to the retaining flanges of the annular top cover frame, a bottom metal ring fastened to the retaining flanges of the base, and a plurality of spiral ribs connected between the top metal ring and the bottom metal ring in such a manner that the collapsible springy receptacle body is collapsed when the top metal ring and the bottom metal ring are twisted and attached to each other. According to another aspect of the present invention, the base tray has a plurality of outward lugs respectively and outwardly raised from its upright outer wall; the annular top cover frame comprises a plurality of inwardly extended bottom coupling flanges, which are forced into engagement with the outward lugs of the base to hold the collapsible garbage receptacle collapsed. According to another aspect of the present invention, the collapsible springy receptacle body immediately returns to its former shape to hold the collapsible garbage receptacle in the operative condition when the bottom coupling flanges of the annular top cover frame are disengaged from the outward lugs of the base.

DETAILED DESCRIPTION OF THE PREFERRED EMBODIMENT

Figure 1:
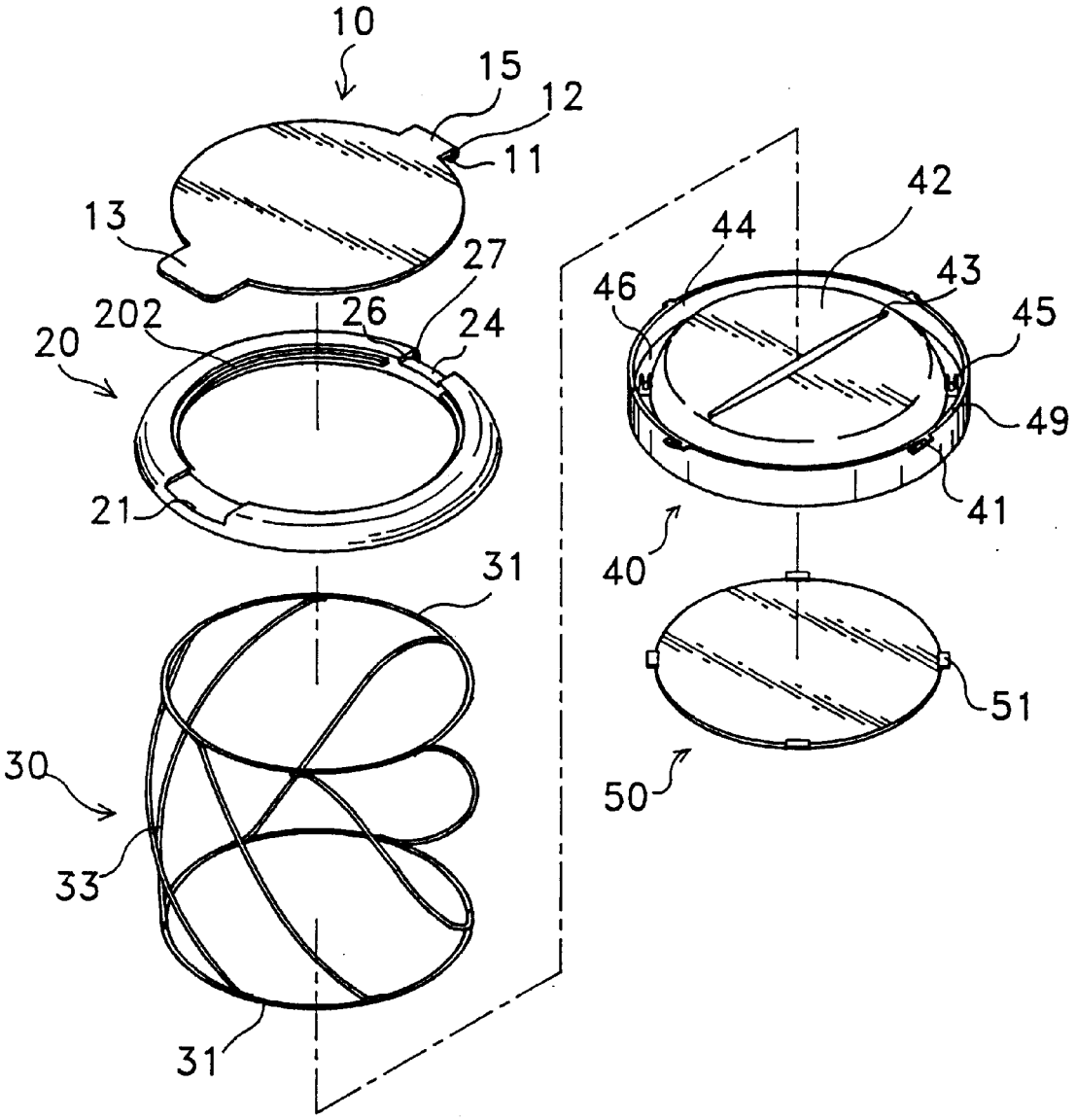
FIG. 1 is an exploded view of a collapsible garbage receptacle according to a first embodiment of the present invention.

Referring to FIGS. from 1 to 3, a collapsible garbage receptacle in accordance with the present invention is generally comprised of a top cover plate 10, an annular cover frame 20, a collapsible springy receptacle body 30, a circular base tray 40, and a circular bottom cover plate 50.

Figure 2:
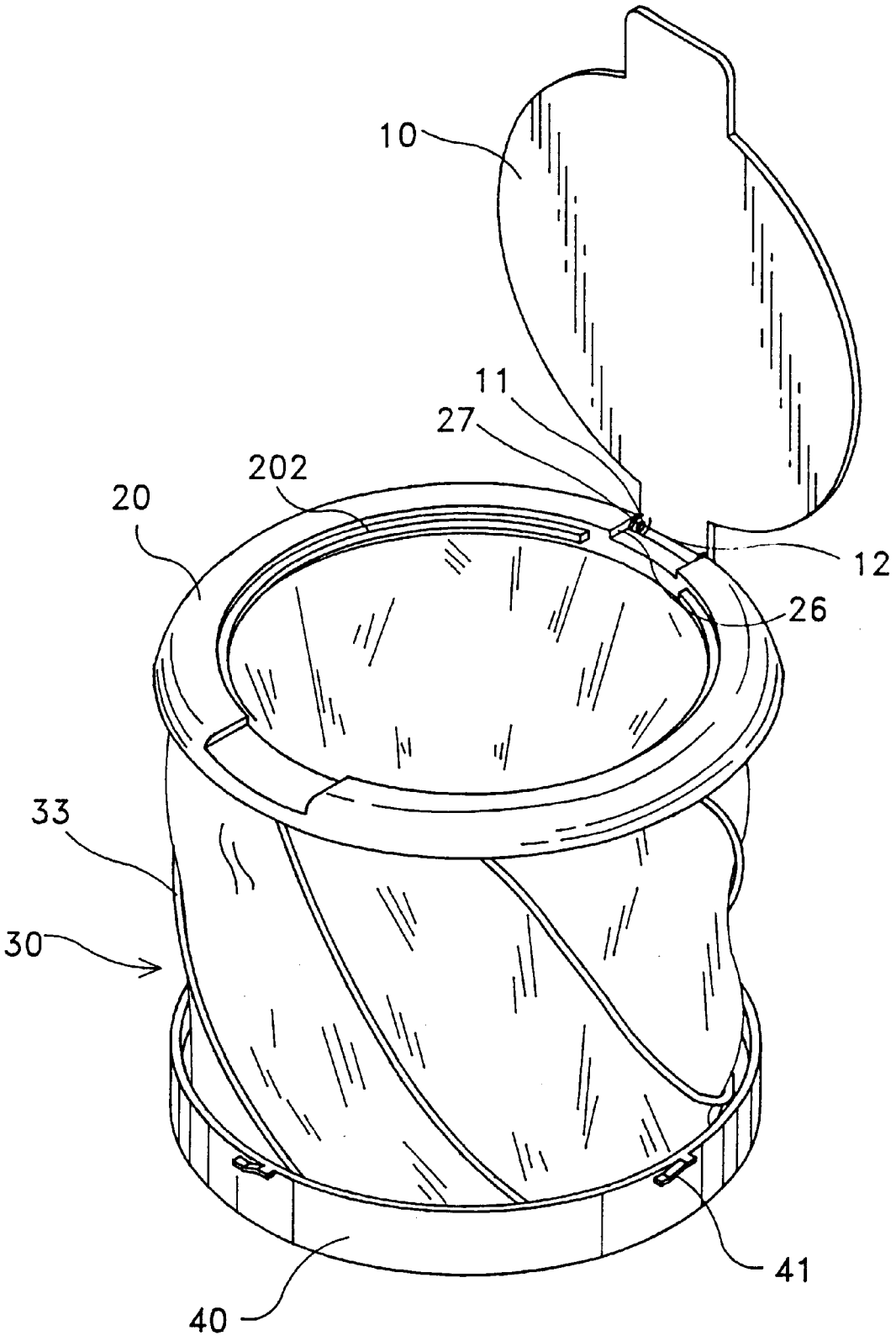
FIG. 2 is a perspective assembly view of the collapsible garbage receptacle shown in FIG. 1.

The annular cover frame 20 comprises a vertical outside wall 28, a vertical inside wall 29, a plurality of downward retaining flanges 25 disposed on the inside and spaced between the vertical outside wall 28 and the inside wall 29, a plurality of inwardly extended coupling flanges 23 equiangularly spaced at a bottom of the outside wall 28, an inwardly extended inside annular flange 202 raised around the vertical inside wall 29, a first top recess 21 and a second top recess 24 symmetrically disposed at two opposite locations, two pivot pins 27 respectively raised from two opposite vertical side walls 26 of the second top recess 24. The top cover plate 10 fits over the inside annular flange 202 of the annular cover frame 20, comprising a first projecting flange 13 and a second projecting flange 15 respectively and horizontally extended from its periphery in reversed directions, two barrels 12 integral with the second projecting flange 15 and defining a respective pivot hole 11. The top cover plate 10 is pivoted to the annular cover frame 20 by inserting the pivot pins 27 of the annular cover frame 20 into the pivot holes 11 of the barrels 12 of the top cover plate 10. The collapsible springy receptacle body 30 comprises two steel rings 31 and a plurality of parallel sprial curved steel wire ribs 33 connected between the steel rings 31. The circular base tray 40 comprises an annular upright outer wall 49, a plurality of outward lugs 41 raised around the annular upright outer wall 49 and adapted for coupling to the bottom coupling flanges 23 of the vertical outside wall 28 of the annular cover frame 20, a top wall 42 raised from an inner wall 44 and defining a bottom chamber 48, an annular groove 46 defined within the upright outer wall 49 around the inner wall 44, a plurality of upright retaining flanges 45 spaced in the annular groove 46 corresponding to the downward retaining flanges 25 of the annular cover frame 20, an elongated slot 43 at the top wall 42, and a plurality of inside coupling grooves 47. The bottom cover plate 50 has a plurality of coupling flanges 51 raised around the periphery and adapted for coupling to the inside coupling grooves 47 of the base tray 40. By forcing the coupling flanges 51 of the bottom cover plate 50 into engagement with the inside coupling grooves 47 of the base tray 40, the bottom cover plate 50 is fastened to the base tray 40 to close the bottom chamber 48. Further, a series of poly-bags 60 is received inside the bottom chamber 48. When in use, the collapsible springy receptacle body 30 is connected between the base tray 40 and the cover frame 20 by fastening the steel rings 31 of the collapsible springy receptacle body 30 to the downward retaining flanges 25 of the cover frame 20 and the upright retaining flanges 45 of the base tray 40. Before fastening the top steel ring 31 of the collapsible springy receptacle body 30 to the cover frame 20, the leading poly-bag of the series of poly-bags 60 is pulled out of the elongated slot 43 of the top wall 42 of the base tray 40 and then turned inside out and covered over the top steel ring 31 of the collapsible springy receptacle body 30. FIG. 2 shows the collapsible garbage receptacle arranged in the operative condition.

Figure 3:
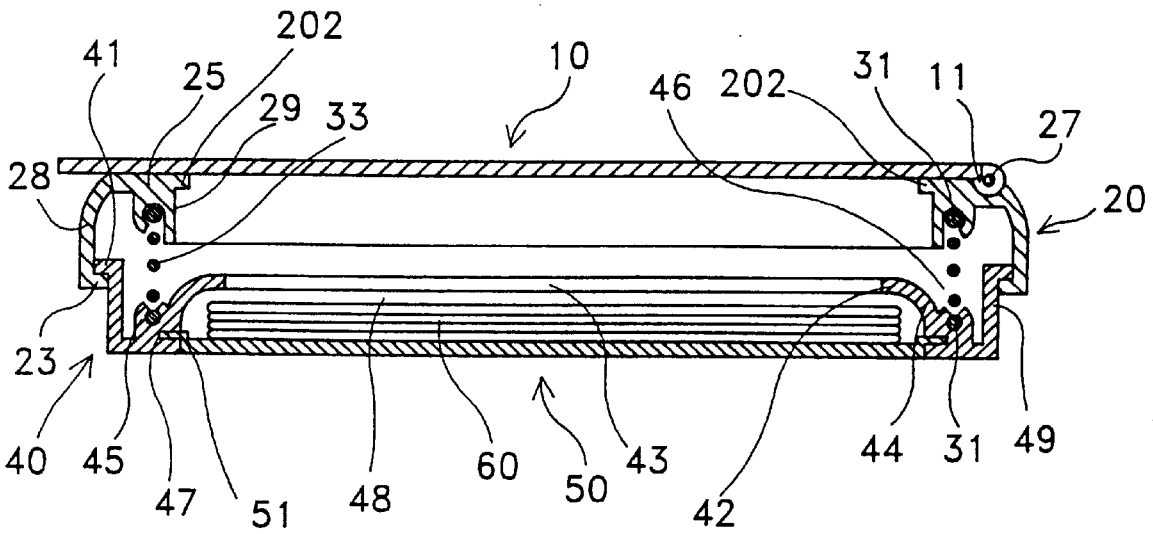
FIG. 3 is a side view in section of the first embodiment of the present invention, showing the collapsible garbage receptacle retained in the collapsed condition.
Figure 4:
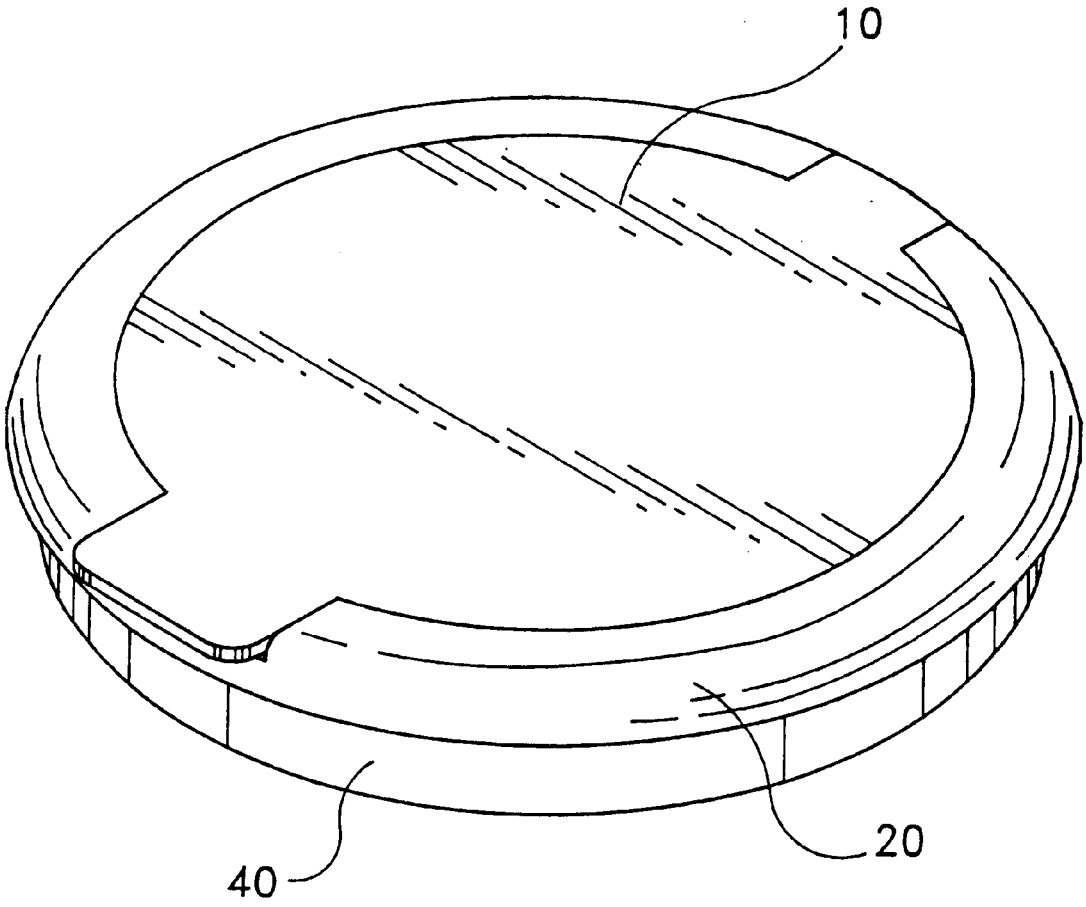
FIG. 4 is an elevational view of FIG. 3.

Referring to FIG. 4 and FIG. 3 again, when not in use, the collapsible springy receptacle body 30 is twisted and compressed into a collapsed condition, and then the inwardly extended bottom coupling flanges 23 of the annular cover frame 20 are respectively forced into engagement with the outward lugs 41 of the base tray 40 to hold the collapsible springy receptacle body 30 in the collapsed condition.

Figure 5:
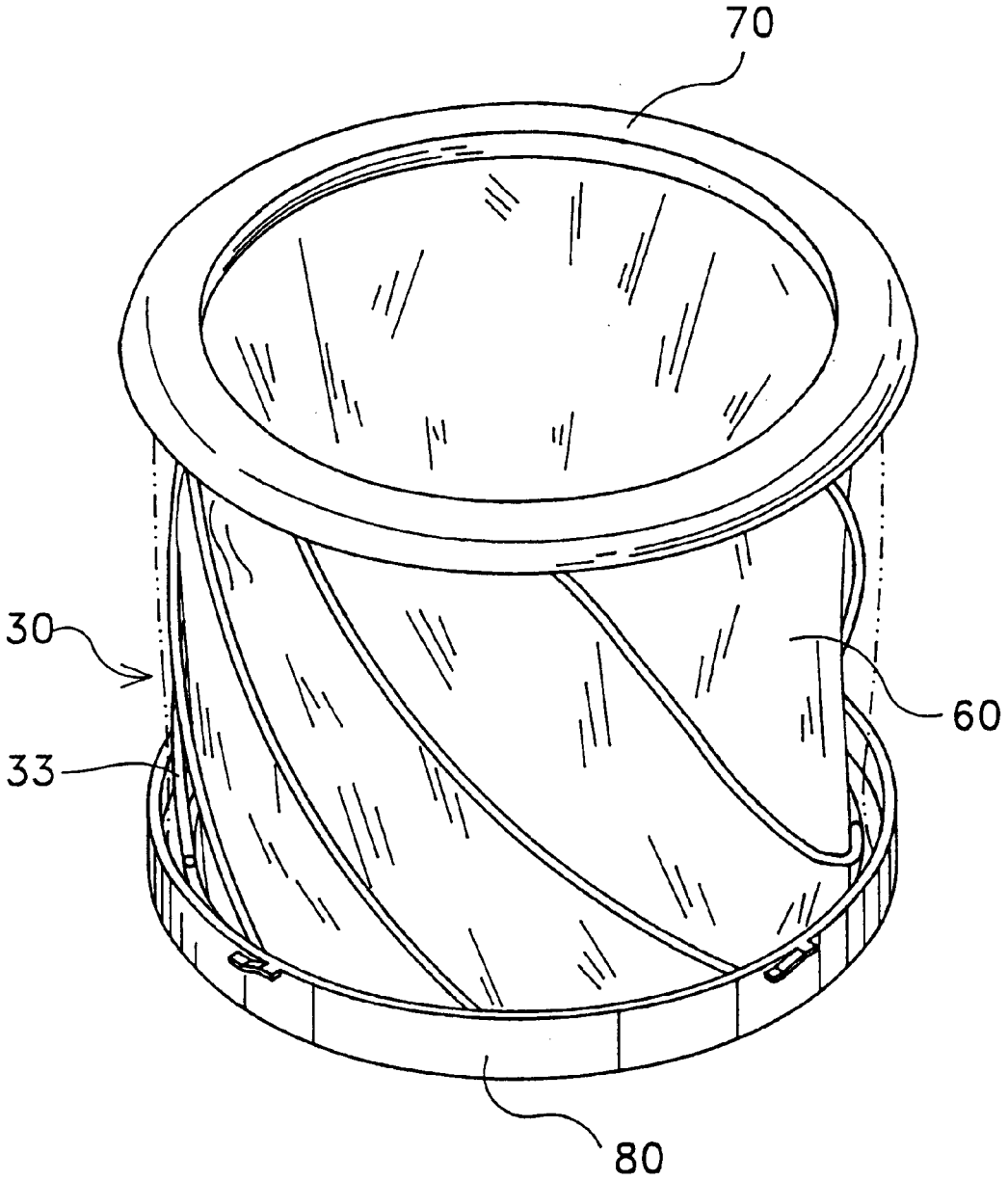
FIG. 5 is an elevational view of a collapsible garbage receptacle according to a second embodiment of the present invention when set in the operative condition.
Figure 6:
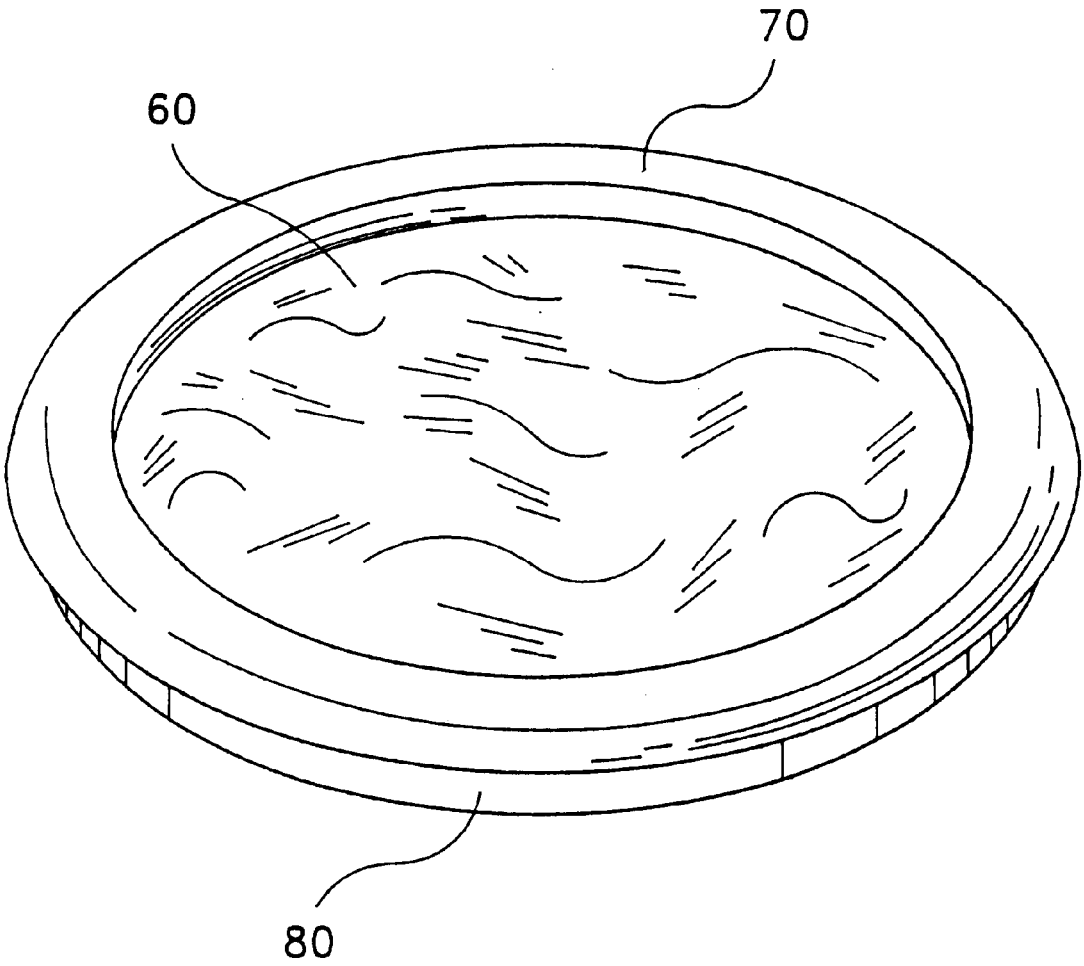
FIG. 6 shows the collapsible garbage receptacle of the second embodiment of the present invention retained in the collapsed condition.

FIGS. 5 and 6 show an alternate form of the present invention. According to this alternate form, the collapsible garbage receptacle is comprised of an annular cover frame 70, a circular base tray 80, and a collapsible springy receptacle body 30 connected between the annular cover frame 70 and the circular base 40. This alternate form eliminates the aforesaid top cover plate 10.

Figure 7:
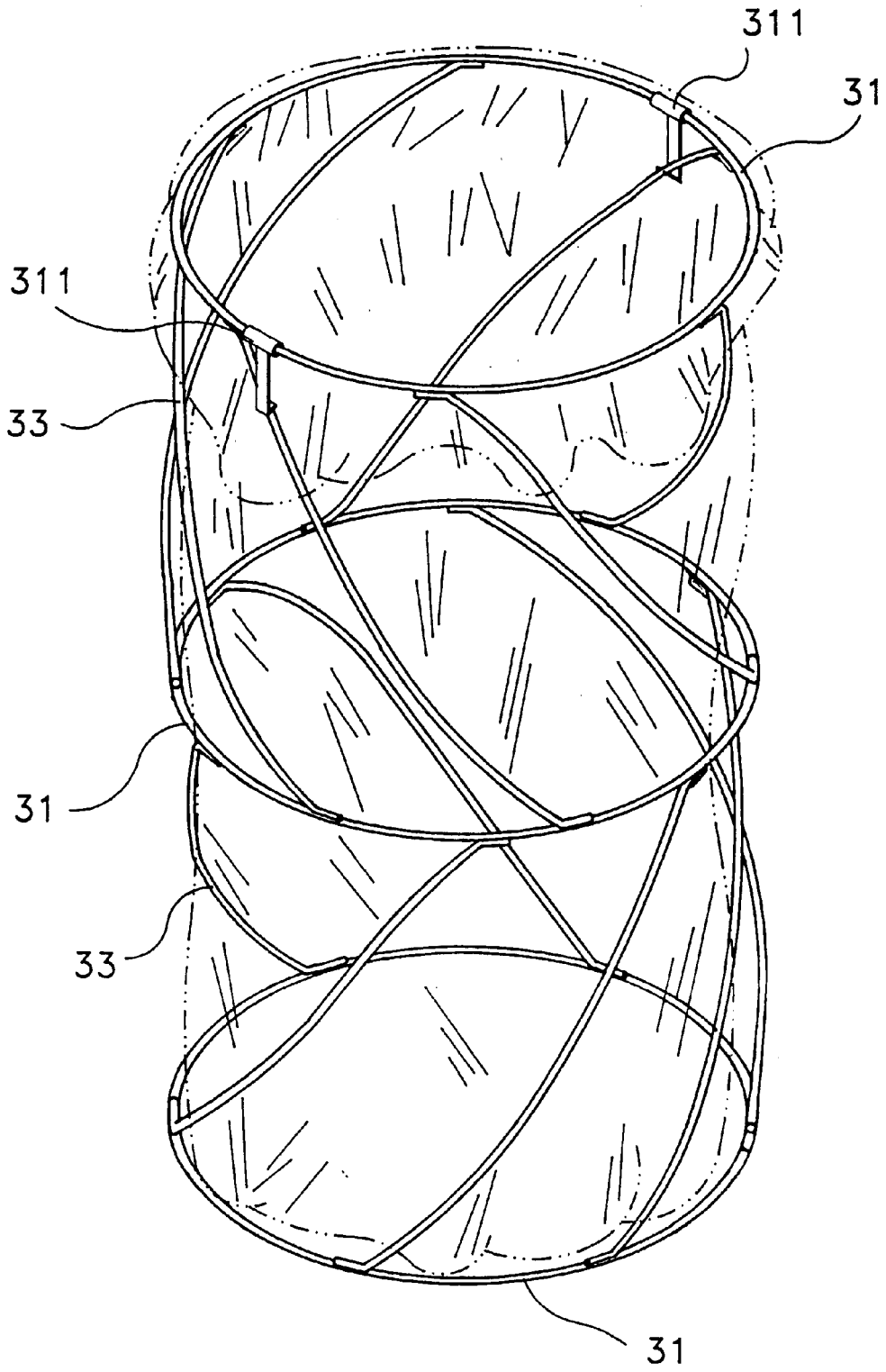
FIG. 7 shows a collapsible garbage receptacle according to a third embodiment of the present invention.

Referring to FIG. 7, the collapsible springy receptacle body 30 can be made having a plurality of steel rings 31, a plurality of steel wire ribs 33 respectively connected between each two steel rings 31, and a plurality of hooks 311 respectively fastened to the top steel ring 31. When the collapsible springy receptacle body 30 is twisted and compressed into a collapsed condition, the hooks 311, the hooks 311 are respectively hooked on the bottom steel ring 31 to hold the collapsible springy receptacle body 30 in the collapsed condition.

It is to be understood that the drawings are designed for purposes of illustration only, and are not intended as a definition of the limits and scope of the invention disclosed.

What the invention claimed is:

1. A collapsible garbage receptacle comprising:

a base tray having an upright outer wall raised around the periphery, and a plurality of equiangularly spaced upright retaining flanges surrounded by said upright outer wall;

an annular top cover frame having a plurality of equiangularly spaced retaining flanges raised from an inner side at a bottom thereof; and a collapsible springy receptacle body connected between said base tray and said annular top cover frame, said collapsible springy receptacle body comprising a top metal ring fastened to said retaining flanges of said annular top cover frame, a bottom metal ring fastened to said retaining flanges of said base tray, and a plurality of parallel spiral curved springy ribs connected between said top metal ring and said bottom metal ring in such a manner that said collapsible springy receptacle body is collapsed when said top metal ring and said bottom metal ring are twisted and attached to each other.

2. The collapsible garbage receptacle of claim 1, wherein said base tray has a plurality of outward lugs respectively and outwardly raised from said upright outer wall; said annular top cover frame comprises a plurality of inwardly extended bottom coupling flanges, which are forced into engagement with the outward lugs of said base to hold the collapsible garbage receptacle in a collapsed condition when said collapsible springy receptacle body is collapsed.

3. The collapsible garbage receptacle of claim 1, wherein said base comprises a top wall raised from its upright outer wall, a bottom chamber defined by said top wall and adapted for holding poly-bags, an elongated slot at said top wall through which a poly-bag is pulled out of said bottom chamber, and a plurality of inside coupling grooves spaced around said bottom chamber; a bottom cover plate is covered on the bottom chamber of said base, said bottom cover plate having a plurality of a plurality of coupling flanges raised around the periphery and respectively forced into engagement with the inside coupling grooves of said base.

4. The collapsible garbage receptacle of claim 1, wherein said annular top cover frame is covered with a pivoted top cover plate.

5. The collapsible garbage receptacle of claim 1, wherein said springy ribs of said collapsible springy receptacle body are made from steel wires.

6. The collapsible garbage receptacle of claim 1, wherein a cloth covering is covered around said collapsible springy receptacle body.

7. A collapsible garbage receptacle comprising a collapsible spring receptacle body, said collapsible springy receptacle body comprising a top metal ring, a bottom metal ring, at least one metal intermediate ring connected between said top metal ring and said bottom metal ring, a plurality of springy wire ribs connected between said top metal ring, said at least one metal intermediate ring and said bottom metal ring, and a plurality of hooks respectively fastened to said top metal ring and adapted for hooking on said bottom metal ring to hold said collapsible spring receptacle body in a collapsed condition when said top metal ring and said bottom metal ring are twisted relative to each other and attached to each other.

8. The collapsible garbage receptacle of claim 7 further comprising a base having an upright outer wall raised around the periphery, and a plurality of equiangularly spaced upright retaining flanges surrounding said upright outer wall and adapted for holding the bottom metal ring of said collapsible springy receptacle body.

9. The collapsible garbage receptacle of claim 7 further comprising an annular top cover frame covered on the top metal ring of said collapsible springy receptacle body, said annular top cover frame having a plurality of downward retaining flanges respectively forced into engagement with the top metal ring of said collapsible springy receptacle body.

* * * * *